United States Patent [19]

Pradon

[11] 4,100,995

[45] Jul. 18, 1978

[54] TELESCOPIC SET OF STEPS WITH VARIABLE SLOPE

[76] Inventor: Jacques Pradon, 19, avenue des Tourelles, 94100 Saint-Maur-des-Fosses, France

[21] Appl. No.: 768,430

[22] Filed: Feb. 14, 1977

[30] Foreign Application Priority Data

Feb. 17, 1976 [FR] France ..... 76 04332

[51] Int. Cl.[2] ..... B63B 29/20

[52] U.S. Cl. ..... 182/1; 182/97; 182/164; 182/106; 182/207

[58] Field of Search ..... 182/1, 97, 163, 164, 182/207, 95, 98

[56] References Cited

U.S. PATENT DOCUMENTS

| | | | |
|---|---|---|---|
| 1,590,317 | 6/1926 | Richards | 182/1 |
| 2,812,528 | 11/1957 | Odell | 182/1 |
| 3,139,949 | 7/1964 | Graves | 182/164 |
| 3,970,169 | 7/1976 | Gonzalez | 182/1 |
| 4,013,140 | 3/1977 | Pradon | 182/1 |

*Primary Examiner*—Reinaldo P. Machado
*Attorney, Agent, or Firm*—Haseltine, Lake & Waters

[57] ABSTRACT

A telescopic set of steps comprises at least two frames, each of which consists of two parallel members forming stringboards, one end of one of the frames being pivoted to a fixed support for pivotal movement about a horizontal axis, and the other frame being slidable along the pivoted frame, means for varying the slope of the set of steps, a plurality of steps pivoted about respective axes parallel to the said horizontal axis and comprising a first group of steps mounted directly on the sliding frame, and a second group of steps, each of which has an axle mounted on a respective pair of supports which are slidable along a pair of slideways formed on respective stringboards of the pivoted frame, slideway extensions extending onto the fixed support to a distance at least equal to the length of the sliding frame, means for maintaining a constant spacing between the pivot axes of the steps, means for maintaining the steps parallel to one another, and means for setting the inclination of at least one step.

8 Claims, 4 Drawing Figures

TELESCOPIC SET OF STEPS WITH VARIABLE SLOPE

The object of the invention is a telescopic set of steps with variable slope, which can be used to provide access to a place which varies in position both vertically and horizontally.

The invention is particularly, but not exclusively, concerned with sets of steps for providing access to a platform such as the deck of a ship, from a building or quayside. As the position of such a platform can vary, it is usual to make use of sets of steps which can be adjusted in length and in slope. Such sets of steps generally include at least two frames, each of which consists of two parallel beams forming stringboards; one of the frames is pivotally attached at one end to a fixed support at the level of an entrance to a building, the other frame being able to slide along the pivoted frame.

In conventional embodiments of such sets of steps, each frame has a flight of steps, the flights fitting one under the other, as in an extending ladder. This arrangement produces a potentially dangerous area where one has to pass from one flight of steps to the other.

It is an object of the invention to provide a telescopic set of steps which, while being adjustable in length and slope, carries a series of steps which make up a continuous flight of steps.

In accordance with the invention there is provided a telescopic set of steps comprising:

at least two frames each comprising two parallel members forming stringboards;

means for pivotally connecting one end of one of said frames to a fixed support, for pivotal movement about a horizontal axis;

means mounting the other of said frames for sliding movement along said one frame;

means for varying the slope of said set of steps;

a plurality of individual steps comprising a first group of steps and a second group of steps;

means pivotally mounting the steps of said first group of steps directly on said other frame for pivotal movement about an axis parallel to said horizontal axis;

means mounting each step of said second group of steps on a respective axle for pivotal movement about an axis parallel to said axes of said first group of steps;

a pair of supports mounted on each end of each axle;

a pair of slideways formed on the said stringboards of said one frame and receiving respective said supports of said axles of said steps of said second group of steps and along which said supports are slidable;

slideway extensions extending said slideways by a distance at least equal to the length of said other frame and being adapted to be arranged on said fixed support;

means for maintaining a constant spacing between the pivot axes of said steps;

means for maintaining the steps parallel to one another; and means for setting the inclination of at least one said step.

The invention will be more fully understood from the following description of an embodiment thereof, given by way of example only, with reference to the accompanying drawings.

Figures 1, 4:
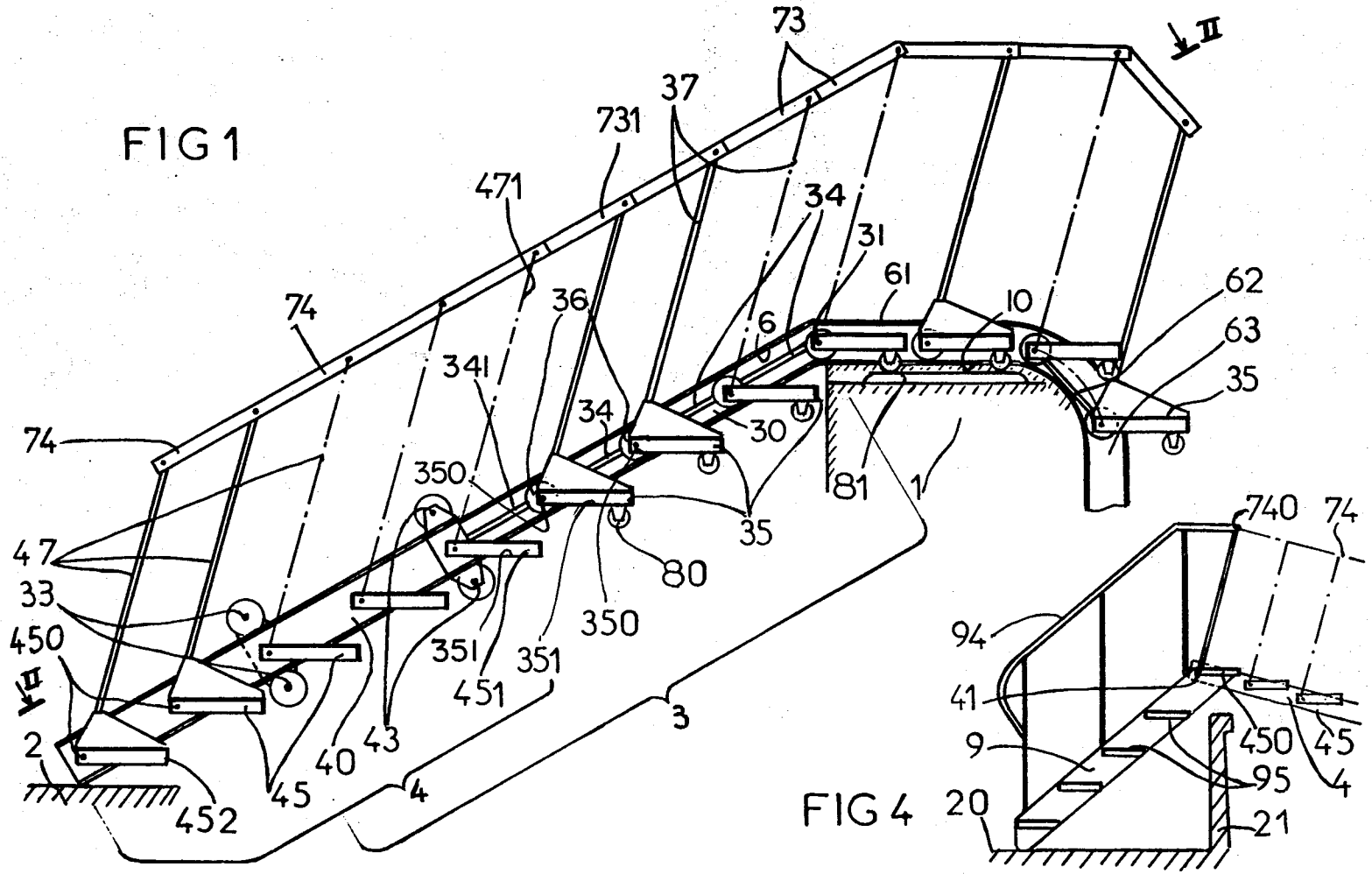
FIG. 1 is a side view of an embodiment of a set of steps in accordance with the invention.
FIG. 4 is a detailed view of a modified form of the end section of the set of steps.

In the embodiment shown in the drawings, the set of steps is mounted on a fixed support 1 which may, for example, be a landing giving access to a building, the set of steps providing access from the building to a platform 2 which may, for example, be the deck of a ship.

The set of steps comprises two frames 3 and 4, one of which can slide on the other. The frame 3 consists of two parallel beams 30 which form stringboards and are pivoted to the fixed support 1 about an axis 31. The frame 4 consists of two parallel beams 40 each of which passes between two rollers 33 mounted at the ends of the beams 30, each of the beams 40 also having at one of their ends pairs of rollers 43 which act as idler wheels running on either side of the corresponding beam 30 of the frame 3. The rollers 33, 43 of each pair are spaced by a distance corresponding to the thickness of the beam received between them so that they rest one on the upper surface and one on the lower surface of the respective beam. The frame 4 can therefore slide freely along the frame 3. Sliding of the frame 4 along the frame 3 and holding of the frame 4 in a given position are controlled by a conventional system which has not been shown so as to avoid complicating the drawings, this system using cables, chains, or cylinders.

The slope of the set of steps can be controlled by rotating it about the axis 31, by means for example of a cylinder (not shown).

The set of steps has a series of individual steps pivoted about respective axes parallel to the pivotal axis of the set of steps, and this series of steps is sub-divided into two groups.

Figure 3:
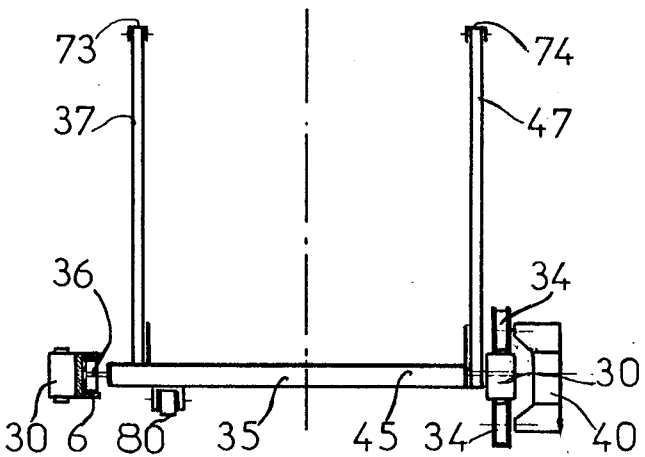
FIG. 3 is a section on the line III—III in FIG. 2.

The steps 45 of the first of these groups are pivoted directly on the beams 40 of the frame 4, by respective spindles 450. The steps 35 of the second group are pivoted about respective axles 350, which axles 350 have a roller 36 at each end, outside the step, the rollers 36 rolling in slideways 6 fixed along the length of the beams 30. As can be seen in the left part of FIG. 3, which is a cross-section transverse to the beams 30, each slideway 6 consists of a channel-section on its side, the flanges of the section lying respectively above and below the rollers 36. The distance between the flanges is slightly greater than the diameter of the rollers 36, so that the latter can slide freely inside the slideway, resting on the lower flange.

There is a fixed distance between the pivot axes of all the steps.

This separation is maintained in the case of the steps 45 by virtue of the fact that they are pivotted about spindles 450 which are mounted directly on the beams 40.

Figure 2:
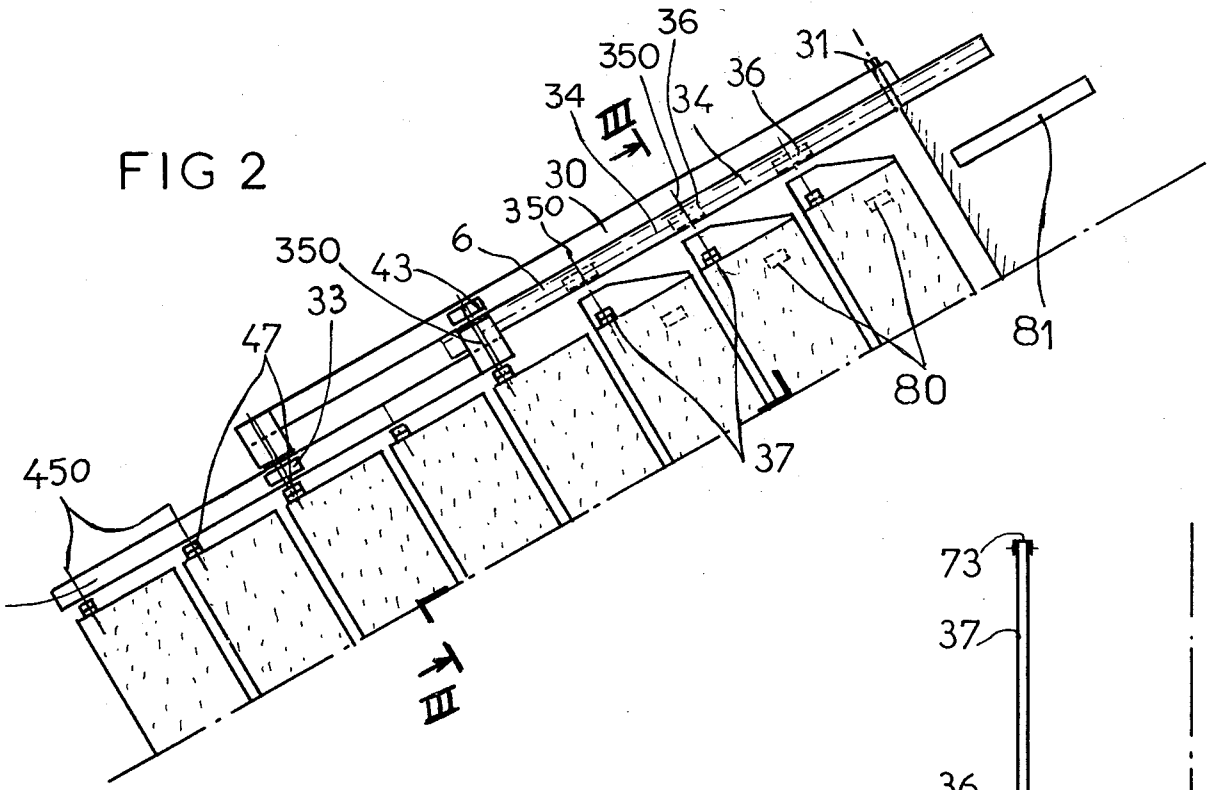
FIG. 2 is a view on the line II—II in FIG. 1, showing only one half of the set of steps.

The steps 35, however, are separately mounted, resting on the beams 30 through their respective axles and rollers. The separation of the steps 35 is therefore maintained by means of links 34 between the steps, each link having its end pivoted to the axles 350 of adjacent steps. In FIG. 2 these links are shown schematically, in order to simplify the drawing. They are all of the same length.

The fixed support 1 is normally provided with a horizontal stage 10 leading to the set of steps. The slideways 6 fitted along the beams 30 are extended by respective horizontal slideways 61 attached to the stage 10. This extension of the slideways means that at least some of the steps can be accommodated on the fixed support 1 when the set of steps is shortened by sliding of the frame 4 up the frame 3. The length of the slideways 61 may be sufficient to accommodate the whole of the sliding frame 4, in which case this length must be at least equal to that of the sliding chassis.

To enable the set of steps to be stowed in a vertical position each slideway 61 is extended by a curved section 62 so that it is connected with a vertical slideway 63.

As the steps 35 are individually supported on respective pairs of rollers, and are interconnected by pivoted links 34, it will be seen that when the frame 4 slides along the frame 3 the rollers 36 are able to slide along the slideways 6 and then the slideways 61, 62 and 63, so that they stow vertically, one above the other, along the length of the slideway 63.

As each step is pivoted about only one axis, the steps must be maintained parallel to one another. A system of articulated parallelograms is used for this purpose.

To each step 45 or 35 there is rigidly attached a rod 47 or 37, respectively. These rods are at a fixed angle to the steps; this angle must not be too acute, and, for reasons which will be explained later, the value of this angle is selected so that when the step is horizontal the upper end of each rod is substantially vertically above one edge of the step, its lower end being attached to the step near the other edge.

The rods 47 and 37 are all parallel, and they are made the same length so that their upper ends form a line parallel to the beams 30 and 40.

The upper ends of the rods 47 are pivoted to a bar 74 which is parallel to and of substantially the same length as the beams 40.

The upper ends of the rods 37 are pivotally connected in pairs to the ends of connecting bars 73 parallel to the slideways 6, 61, 62, 63, each of the bars 73 connecting adjacent rods. Thus each of the bars 73 is parallel to and of the same length as the link 34 connecting the pivot axes of two corresponding steps.

The bar 731 which corresponds to the first step 351 of the frame 3 and which follows on from the frame 4 in the direction towards the support 1 is pivoted to the end of the bar 74 and to the end of the rod 471 of the last step 451 of the flight 45 fixed to the frame 4, and the first link 341 pivoted to the axle of the step 351 is pivoted at its other end to the axle of the last step 451 of the flight 45.

Over the whole length of the frame 3, the connecting bars 73 are aligned with one another and with the bar 74, the assembly forming a handrail along the set of steps.

It will be seen that the assembly forms an articulated parallelogram, and that it is only necessary to set the inclination of one of the steps to determine that of all the steps.

To this end, each step 35 has on its under surface, and preferably adjacent that edge closer to the support 1, a downwardly directed roller 80. A ramp 81 is formed on the support 1, at the height of the platform 10, and the rollers 80 of those steps at the level of the platform roll on this ramp. The ramp 81 is parallel to the slideways 61, and the assembly determines the inclination of all the steps, which are generally set in a horizontal orientation. The leading edge of the ramp 81 is spaced from the axis 31 by a distance equal to that between the rollers 36 and 80 of one of the steps 35, so that the roller 80 on a step engages the ramp 81 at the same time as the roller 36 on the same step passes from the slideway 6 to the slideway 61. The length of the ramp 81 is such that the ramp always engages at least one roller 80 on each side of the set of steps, which ensures that all the steps 35, 45 in groups are horizontal, since the step engaged in the slideways 61 and 81 is horizontal and all the steps are maintained parallel to one another.

As the collecting bars 73 are parallel to the steps, those which correspond to the steps located on the landing 10 will be horizontal. Thus the bars 73 and 74 together form a safety rail, the rods 47 and 37 having a length corresponding to the height of a protective railing.

It will be seen that when the slope of the set of steps is varied the steps remain horizontal. Also, when the frame 4 is slid along the frame 3, which it can do to the point where the edge of the frame 4 comes close to the pivotal axis 31, the steps 35 roll along the slideways 6 and then along the slideways 61, to arrange themselves one above the other along the vertical slideways 63. If the upper ends of the rods 37 are situated vertically above the edges of the steps 35, the set of steps can be stowed away vertically, taking up a width which is no greater than that of a step.

There is no difficulty in changing the length and slope of the set of steps at one and the same time. Also, since the steps are horizontal, the set of steps can extend upwardly to the landing 10, as shown in the drawings, or extend downwardly to it; it will be obvious that if it is to be possible for the set of steps to be changed from the upward configuration to the downward one, the length of each step must not be greater than the distance between the pivotal axes 350 or 450. If this is the case, the set of steps can take up a horizontal configuration, in which it forms an uninterrupted catwalk.

FIG. 4 shows an improvement to the design of the above described set of steps. This improvement consists in a short set of steps 9, rather like a step ladder, consisting of two stringboards pivoted to the outer ends of the beams 45 about a pivot axis 41. The two stringboards are rigidly fixed to the first step 45 of the first group of steps, and therefore retain the same orientation whatever the orientation of the steps 45. Steps 95 with the same orientation are fixed to the stringboards 9, and two rails 94 which are connected to the stringboards by uprights and are pivoted to the ends 740 of the uprights 74. Such a set of steps could be used, for example, to provide a connection between a quayside and the deck of a ship when the level of the deck is likely to vary and where access to the deck 20 has to be over a bulwarks 21 at a place where there is no gap in the latter.

It will be understood that the invention is not intended to be limited to the details of the embodiment which has just been described, and that it covers modifications thereto, especially when such modification amounts only to the use of equivalent means, within the scope of the dependent claims.

If it is necessary to use the bars 73 and 74 as guard rails, the parallel relationships of the steps could be achieved in some other way. It is the same for the way in which the orientation of the steps is maintained.

Construction could be simplified by replacing the rollers which support the individual steps by members which slide along the slideways. The lower rollers which pass over the horizontal ramp of the access landing could similarly be replaced.

Finally, it is not difficult to imagine other forms of construction using the same means. Thus the slideways which guide the steps could be differently arranged, and the ramp for setting the orientation of the steps which is mounted on the landing could just as well be located over the slideways, provided of course that the positions of the rollers which engage this ramp were also altered.

The arrangement in accordance with the invention therefore enables the length and the orientation of the set of steps to be modified at any time, while keeping the steps parallel to one another. An analagous arrangement could, of course, be used for making a set of steps of variable length but fixed slope.

Finally, while the set of steps which has been described has two frames one of which slides on the other, by modifying the system of slideways and step support rollers, it is possible to conceive of the construction of a set of steps having more than two frames.

What is claimed is:

1. A telescopic set of steps comprising:

at least two frames each comprising two parallel members forming stringboards;

means for pivotally connecting one end of one of said frames to a fixed support, for pivotal movement about a horizontal axis;

means mounting the other of said frames for sliding movement along said one frame;

means for varying the slope of said set of steps;

a plurality of individual steps comprising a first group of steps and a second group of steps;

means pivotally mounting the steps of said first group of steps directly on said other frame for pivotal movement about an axis parallel to said horizontal axis;

means mounting each step of said second group of steps on a respective axle for pivotal movement about an axis parallel to said axes of said first group of steps;

a pair of supports mounted on each end of each axle;

a pair of slideways formed on the said stringboards of said one frame and receiving respective said supports of said axles of said steps of said second group of steps and along which said supports are slidable;

slideway extensions extending said slideways by a distance at least equal to the length of said other frame and being adapted to be arranged on said fixed support;

means for maintaining a constant spacing between the pivot axes of said steps;

means for maintaining the steps parallel to one another; and means for setting the inclination of at least one said step.

2. A telescopic set of steps according to claim 1, wherein said supports of said axles of said steps of said second group consist of rollers located one at each end of each said step, the axes of said rollers being aligned with the pivot axes of said steps, and each roller being arranged for rolling along one of said slideways.

3. A telescopic set of steps according to claim 1, wherein said means for maintaining a constant spacing between the pivot axes of the steps of said second group comprise a series of links extending parallel to said stringboards and pivoted at opposite ends to adjacent ones of said steps.

4. A telescopic set of steps according to claim 1, wherein said means for setting the inclination of at least one said step consists of a ramp to be arranged at the level of said slideway extension, each of said steps of said second group being provided with a roller for rolling on said ramp.

5. A telescopic set of steps according to claim 1, wherein said slideway extension includes a horizontal section connected to said slideways and connected via a curved section with a vertical section for stowage of the or some of the steps of said second set of steps.

6. A telescopic set of steps according to claim 1, wherein said means for maintaining the steps parallel to one another includes an articulated parallelogram system comprising, attached to each step a rod extending at a fixed angle to the respective step, the rods being parallel and of the same length and their ends opposite attached to the steps being articulated in pairs to connecting bars.

7. A telescopic set of steps according to claim 6, wherein each of said bars consists of a series of sections pivoted together in sequence to form a handrail along the length of the set of steps.

8. A telescopic set of steps according to claim 6, wherein each of said bars comprises a rigid section with a length which corresponds to that of the other stringboards, and a series of sections pivotally connected to one another and each corresponding to the gap between the axes of two adjacent steps.

* * * * *